United States Patent [19]

Lewis

[11] 4,316,300

[45] Feb. 23, 1982

[54] SWIM PADDLES

[76] Inventor: W. Denison Lewis, 176, Vidal St. S., Apt. 606, Sarnia, Ontario, Canada, N7T-2T6

[21] Appl. No.: 147,567

[22] Filed: May 8, 1980

[51] Int. Cl.[3] ..... B63B 31/12

[52] U.S. Cl. ..... 9/307

[58] Field of Search ..... 9/301, 307, 302, 303, 9/308; 2/16, 22; 16/110 R

[56] References Cited

U.S. PATENT DOCUMENTS

| | | | |
|---|---|---|---|
| 1,140,107 | 5/1915 | Brown | 9/307 |
| 3,107,371 | 10/1963 | Thompson | 9/307 X |
| 3,189,069 | 6/1965 | Stowell | 16/110 R X |
| 3,789,447 | 2/1974 | Lavallee | 9/303 |
| 3,789,448 | 2/1974 | Mitchell | 9/307 |

*Primary Examiner*—Sherman D. Basinger
*Attorney, Agent, or Firm*—William L. Fisher

[57] ABSTRACT

A pair of swim paddles which facilitate swimming constructed to be worn on the forearms of a swimmer, each swim paddle having a length substantially equal to and a width greater than that of the swimmers's forearm, whereby to increase the effective area thereof and correspondingly increase his speed of movement through the water; each swim paddle made of a flexible material having a bottom portion and a pair of side portions, the bottom portion being formed with a friction-gripping surface which grips the underside of the swimmer's forearm to assist in holding the swim paddle in place during use thereof, each side portion having an upper section which projects above the bottom portion and a lower section which projects below the bottom portion, the two lower side sections forming a water scoop with the bottom portion, a pair of straps for holding each swim paddle in place on the swimmer's forearm, each strap encircling the forearm of the swimmer and extending across the bottom portion beneath the bottom surface thereof and through the wall of the two lower side sections, the water scoop formed by the two lower side sections having a first at rest position during a retract stroke of the swimmer in which the two lower side sections are disposed spaced apart from each other, the water scoop also having a second position during a power stroke of the swimmer in which the free ends of the two lower side sections are spread apart from each other further than in the first position.

1 Claim, 13 Drawing Figures

20
21
22
23
9.
11.
13.

SWIM PADDLES

My invention relates to swimming. The principal object of my invention is the provision of swim paddles which facilitate swimming.

The foregoing object of my invention, together with the advantages thereof, will become apparent during the course of the following description, taken in conjunction with the accompanying drawings, in which.

Figures 1, 2, 3, 4, 5, 6, 7, 8, 9, 10, 11, 12, 13:
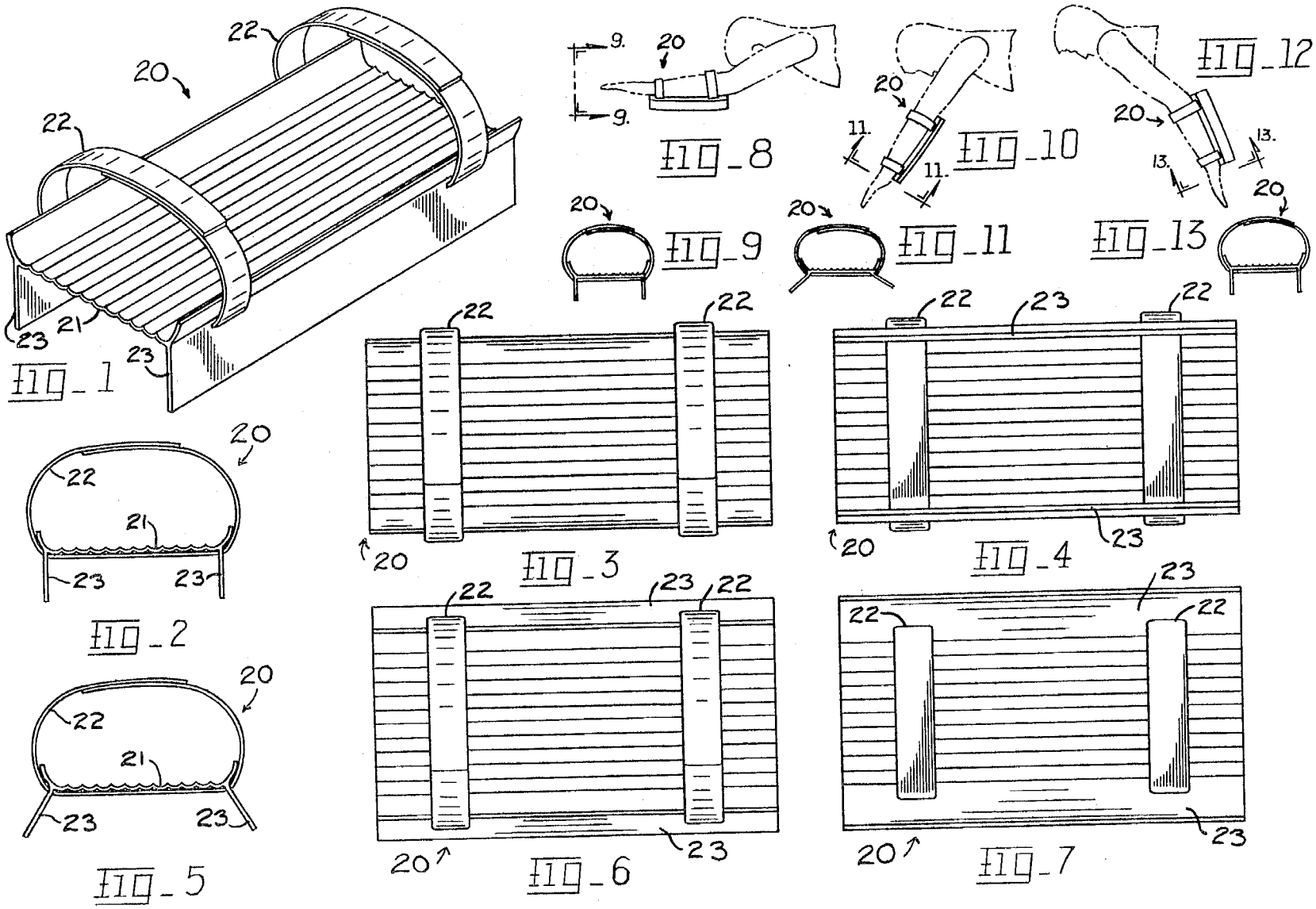
FIG. 1 is a perspective view of a swim paddle embodying my invention.
FIGS. 2–4 are front elevational and top and bottom plan views respectively, of said swim paddle.
FIGS. 5–7 are views corresponding to FIGS. 2–4 of said swim paddle shown in a different operative position thereof.

FIGS. 8, 10 and 12 are respective side elevational views of said swim paddle shown in different operative positions thereof; and FIGS. 9, 11 and 13 are end elevational views of said swim paddle corresponding to FIGS. 8, 10 and 12, respectively.

Referring to the drawings in greater detail, 20 designates said swim paddles which are adapted and intended to be strapped to the swimmer's forearms, as shown, to facilitate swimming. Each swim paddle 20 is made of flexible material, such as rubber, and is of a length at least equal to and of a width slightly greater than the forearm of the swimmer. Each swim paddle 20 has a bottom portion 21 and moveable sides 23 which project rearwardly therefrom and form a water scoop therewith. The bottom portion 21 is fluted in cross-section to assist in holding the swim paddle 20 strapped in place on the swimmer's forearm; a pair of forwardly projecting ribs coextensive with the sides 23 also assist in this holding function. Said ribs, bottom portion 21 and sides 23 are integrally molded in one piece, in the instance. The straps 22 wrap around these ribs and extend beneath said bottom portion 21 and through apertures in the sides 23; said apertures may be reinforced, if desired.

The swim paddles 20 increase the effective area of the swimmer's forearms during each power stroke and correspondingly increase his speed of movement. With little or no pressure, the sides 23 tend to remain substantially perpendicular to the bottom portion 21 as shown in FIGS. 2–4, 8, 9, 12 and 13, but with pressure developed during the power stroke, the sides 23 spread apart as shown in FIGS. 5–7, 10 and 11 to increase even that area provided by the bottom portion 21.

A swimmer can enjoy the benefits of more than 75% greater effective area of his forearms using the swim paddles 20 than without them. Such increase in effective area produces at least a one-third greater force of propulsion of the swimmer through the water.

It will thus be seen that there has been provided by my invention swim paddles in which the object hereinabove set forth, together with many thoroughly practical advantages, has been successfully achieved. While a preferred embodiment of my invention has been shown and described, it is to be understood that variations and changes may be resorted to without departing from the spirit of my invention as defined by the appended claims.

What I claim is:

1. A pair of swim paddles which facilitate swimming constructed to be worn on the forearms of a swimmer, each swim paddle having a length substantially equal to and a width greater than that of the swimmer's forearm, whereby to increase the effective area thereof and correspondingly increase his speed of movement through the water; each swim paddle made of a flexible material having a bottom portion and a pair of side portions, said bottom portion being formed with a fluted friction-gripping surface which grips the underside of the swimmer's forearm to assist in holding the swim paddle in place during use thereof, each side portion having an upper section which projects above said bottom portion and a lower section which projects below said bottom portion, said two lower side sections forming a water scoop with said bottom portion, a pair of straps for holding each swim paddle in place on the swimmer's forearm, each strap encircling the forearm of the swimmer and extending across the bottom portion beneath the bottom surface thereof and through the wall of the two lower side sections, the water scoop formed by the two lower side sections, having a first at rest position during a retract stroke of the swimmer in which the two lower side sections are disposed spaced apart from each other, said water scoop having a second position during a power stroke of the swimmer in which the free ends of the two lower side sections are spread apart from each other further than in said first position.

* * * * *